United States Patent [19]

Johnson

[11] 3,932,946

[45] Jan. 20, 1976

[54] MODULAR TOBACCO HANDLING AND CURING SYSTEM AND METHOD

[75] Inventor: William H. Johnson, Raleigh, N.C.

[73] Assignee: Research Corporation, New York, N.Y.

[22] Filed: Dec. 18, 1973

[21] Appl. No.: 425,848

Related U.S. Application Data

[63] Continuation of Ser. No. 288,028, Sept. 11, 1972, abandoned.

[52] U.S. Cl. ..... 34/201; 34/219; 34/236; 131/134; 220/1.5; 432/500

[51] Int. Cl.[2] ..... F26B 19/00

[58] Field of Search ..... 34/172, 178, 192, 195, 34/197–201, 219, 223, 225, 237, 238, 236, 239; 131/127, 120, 136, 133, 140 R, 134; 432/500, 258, 261; 220/10, 11, 19, 1.5; 217/42; 56/27.5

[56] References Cited

UNITED STATES PATENTS

| | | | |
|---|---|---|---|
| 1,216,442 | 2/1917 | Haley | 34/193 |
| 2,035,838 | 3/1936 | Reeder et al. | 220/1.5 |
| 2,109,409 | 2/1938 | Bogaty | 131/136 |
| 3,337,967 | 8/1967 | Smith | 34/225 |
| 3,399,680 | 9/1968 | Egri | 34/219 |
| 3,855,451 | 12/1974 | Lee | 34/219 |

FOREIGN PATENTS OR APPLICATIONS

| | | | |
|---|---|---|---|
| 1,065,600 | 9/1959 | Germany | 34/229 |

*Primary Examiner*—Kenneth W. Sprague
*Assistant Examiner*—James C. Yeung
*Attorney, Agent, or Firm*—Harold L. Stowell

[57] ABSTRACT

A tobacco handling and curing system and method is provided and in one aspect includes a curing container of generally rectangular solid configuration of which four side walls are generally imperforate and a pair of opposed side walls are perforate for the passage of curing gas therethrough. Such container may include one or more perforate interior transverse walls parallel to the opposed walls; adjustable edge baffles for the perforate side walls; and means carried by a pair of imperforate side walls to assist in handling the container. In another aspect of the present invention, novel curing mechanism is provided to receive a plurality of the containers and to direct gas therethrough at predeterminable temperature, humidity and volume.

10 Claims, 18 Drawing Figures

MODULAR TOBACCO HANDLING AND CURING SYSTEM AND METHOD

This is a continuation, of application Ser. No. 288,028 filed Sept. 11, 1972, now abandoned.

THE INVENTION

This invention relates to a new and improved system for handling and curing tobacco, in either intact or cut strip form, which materially simplifies the materials handling problems of tobacco, harvesting and curing.

It is a particular object of the present invention to provide curing containers or modules which receive either intact or cut strip tobacco and once the containers or modules are filled, the tobacco itself is not physically handled by operators or machines until the tobacco is fully cured or cured and conditioned.

It is an object to provide such containers or modules which include means for controlling the flow of curing gases through the tobacco and means for facilitating the machine handling of the modules.

It is a further object to provide a means or system for handling and curing of large batches of tobacco in specially constructed containers or modules, each of which may hold up to, for example, 1500 or more pounds of tobacco.

Another object is to provide a module which includes features of rotatability for orientation of the tobacco after filling and ease of unloading after curing and screen dividers for support of the tobacco and to permit curing airflow therethrough;

A further object is to provide such a module which lends itself to mechanical handling by conventional handling vehicles such as forklift, tractor lift, or other mechanical aids.

Another object is to provide a system including a module which can be directly filled from mechanical harvesting apparatus and transported to a curing site.

In another aspect of the present invention it is an object to provide an improved curing station which receives a plurality of the filled modules which station includes means to urge forced air, which is heated and recirculated, through the modules as required to thereby materially improve the uniformity of the product, reduce hand labor, curing time and ultimately the cost of tobacco production.

It is another object to provide such a module curing station which includes a special foundation structure which serves as an air supply plenum, curing modules which seal directly with the foundation, a top air plenum which lowers and raises to seal or unseal with the top portion of the modules and a forced air heating and/or humidifying unit which connects with both the top and the bottom plenums.

These and other objects and advantages will become apparent to those skilled in the art from the following detailed description of the present invention when considered in light of the accompanying drawings wherein.

Figure 11:
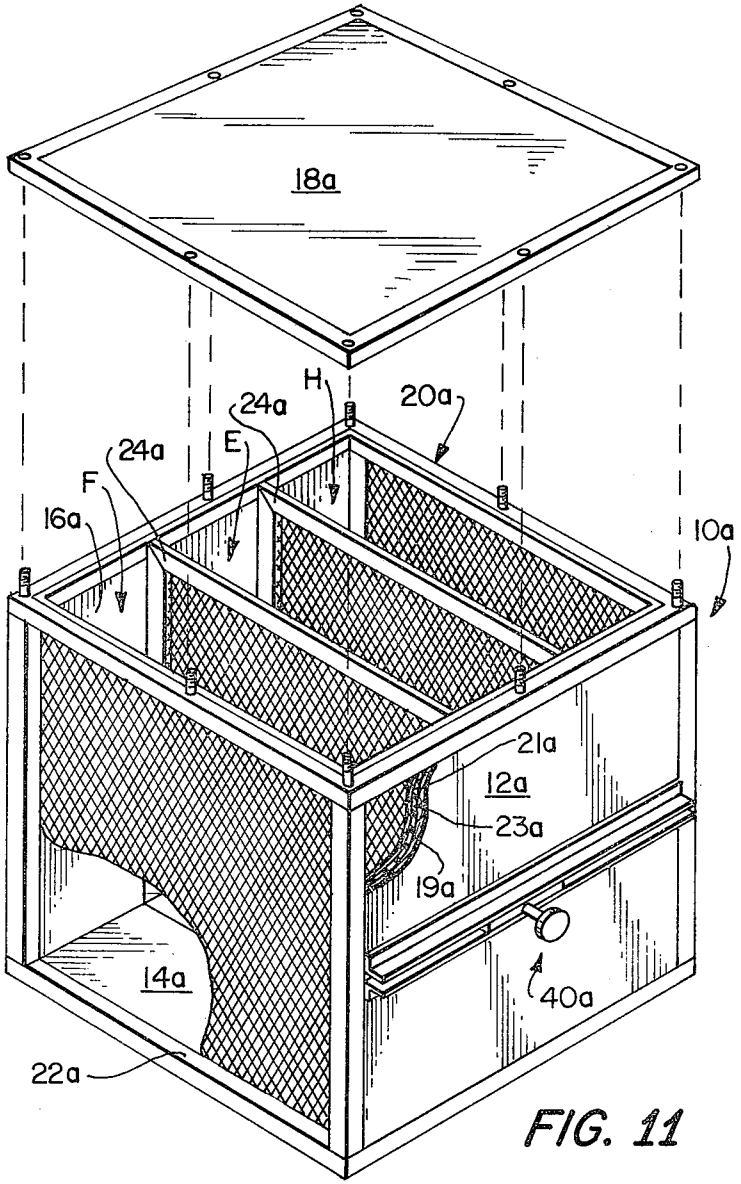
Figure 6:
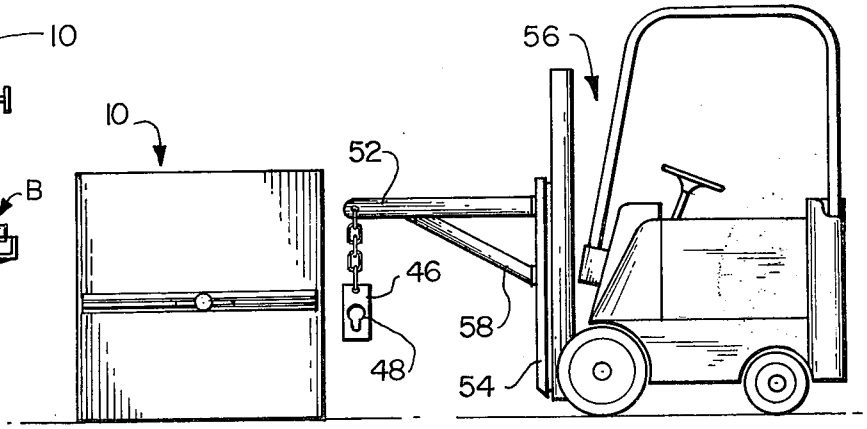
Figure 6A:
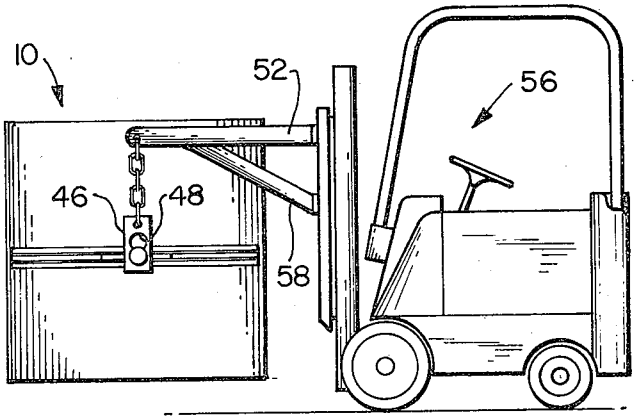
Figure 5:
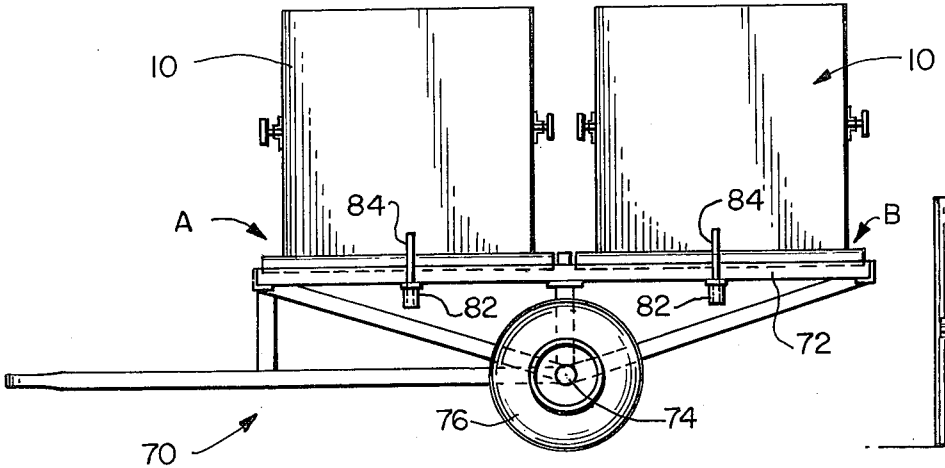
FIG. 5 is an elevational view of a module transporting vehicle with two modules received thereon.
Figure 5A:
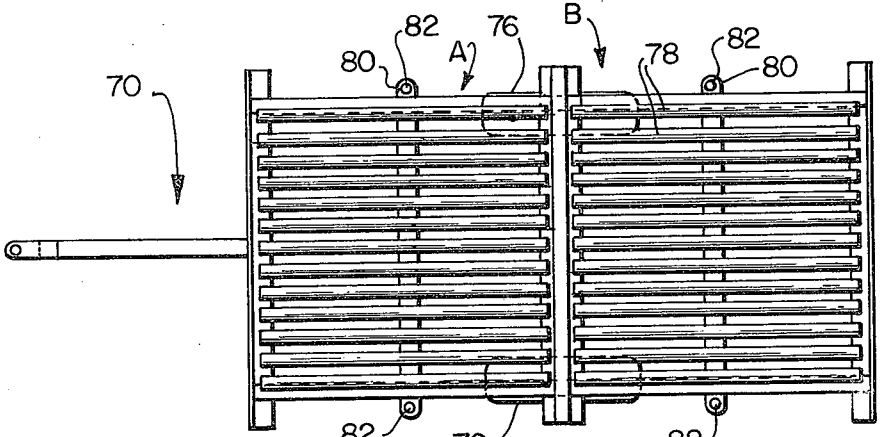
Figure 7:
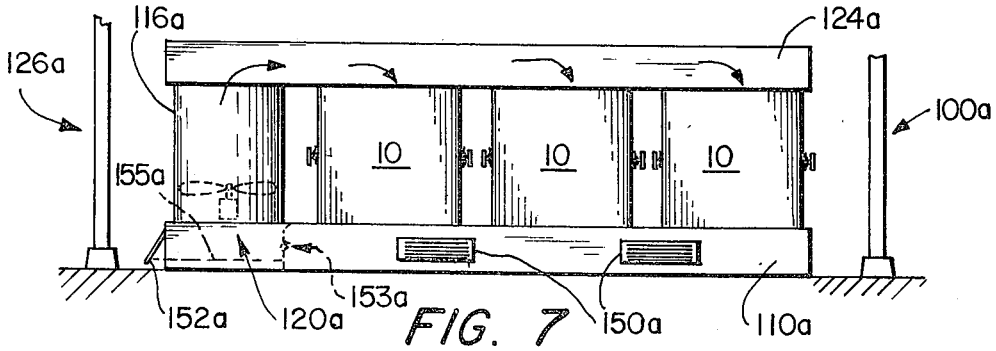
Figure 8:
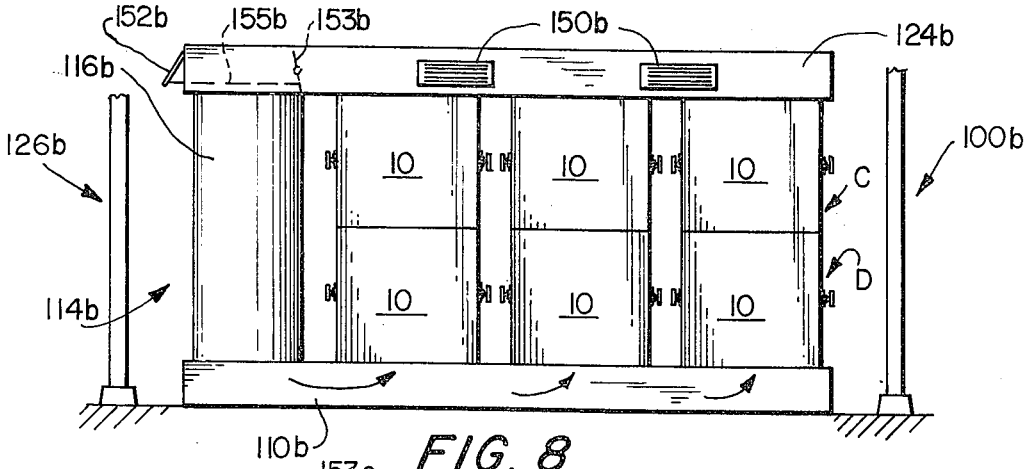
Figure 9:
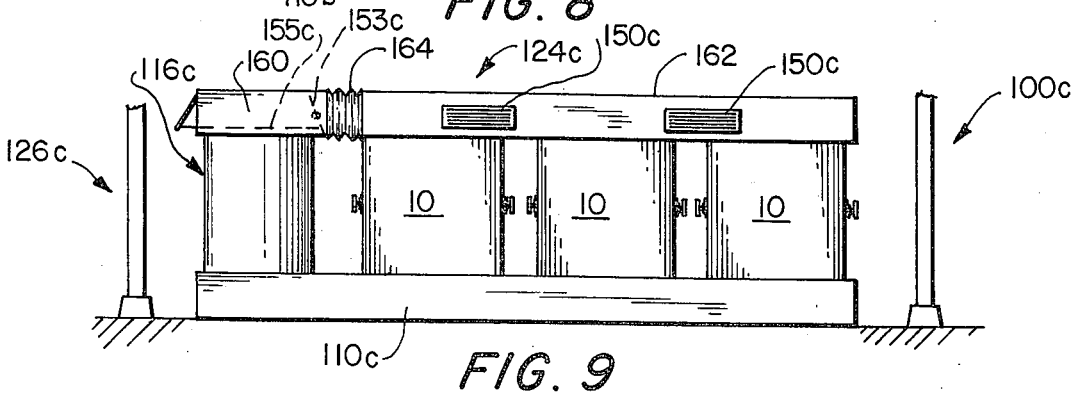
Figure 10:
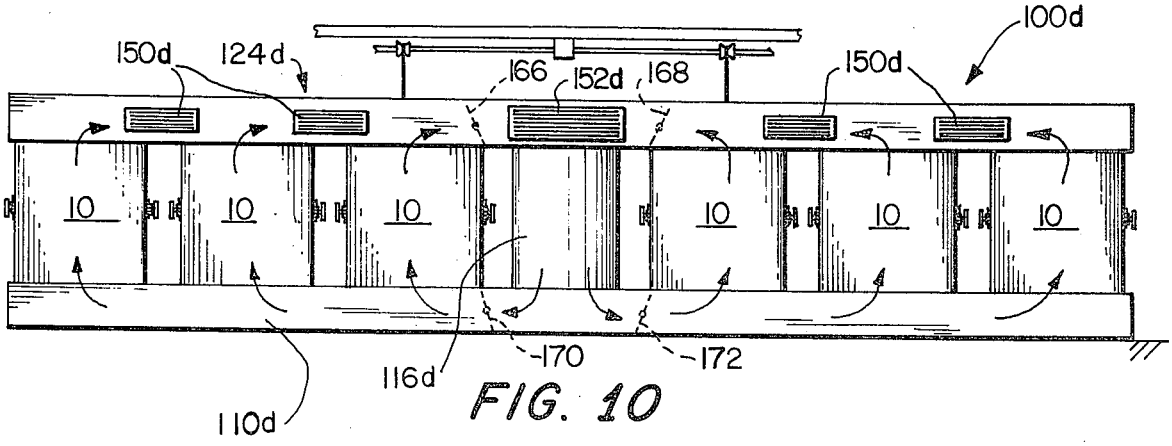
Figure 12:
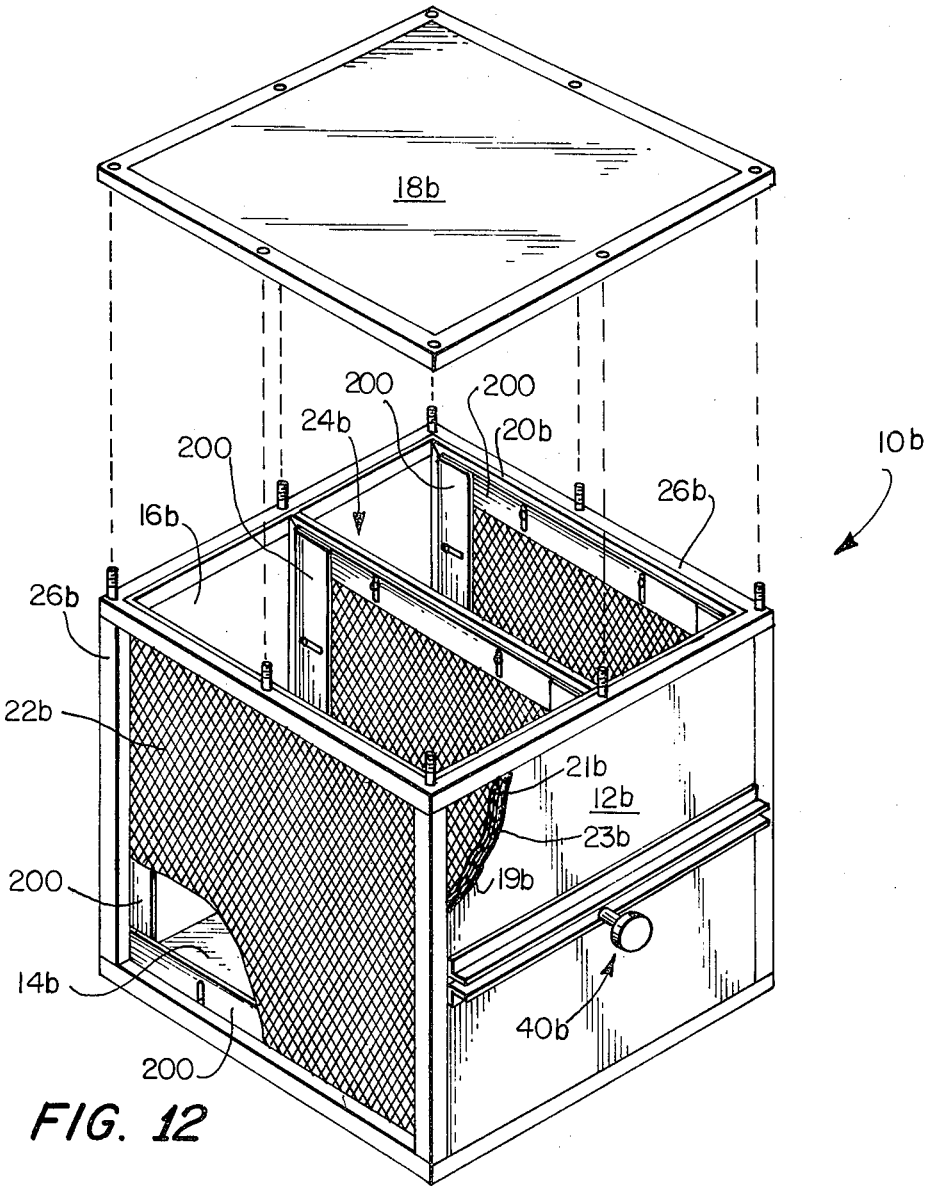
Figure 13:
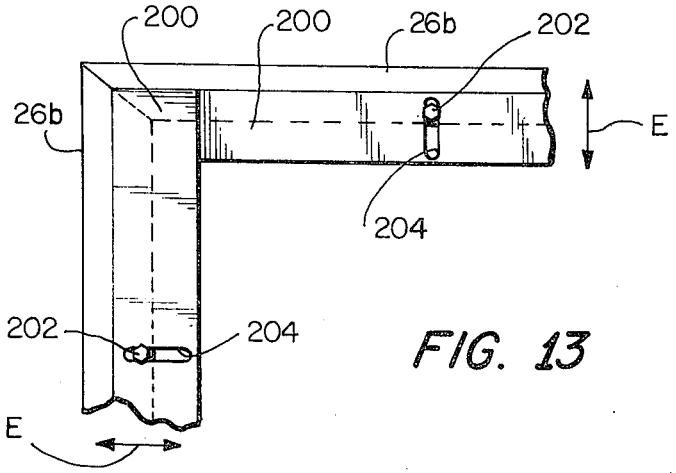
Figure 15:
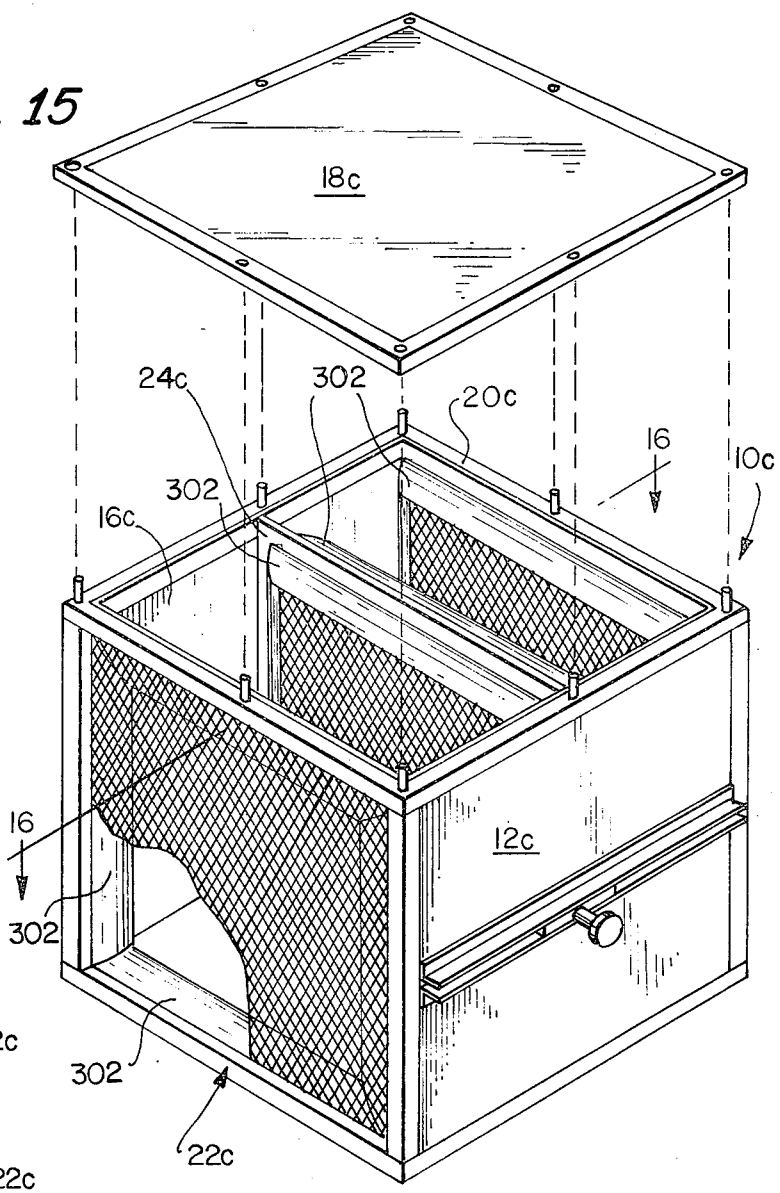
Figure 16:
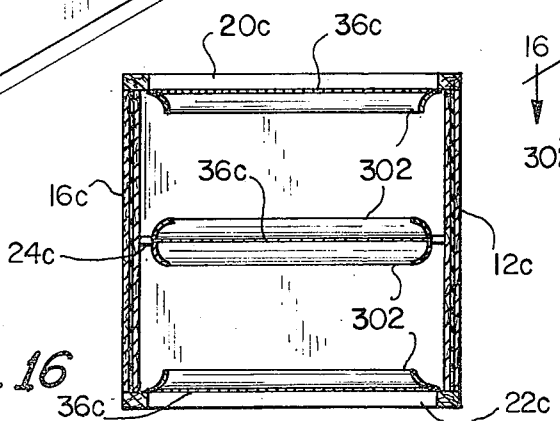
Figure 14:
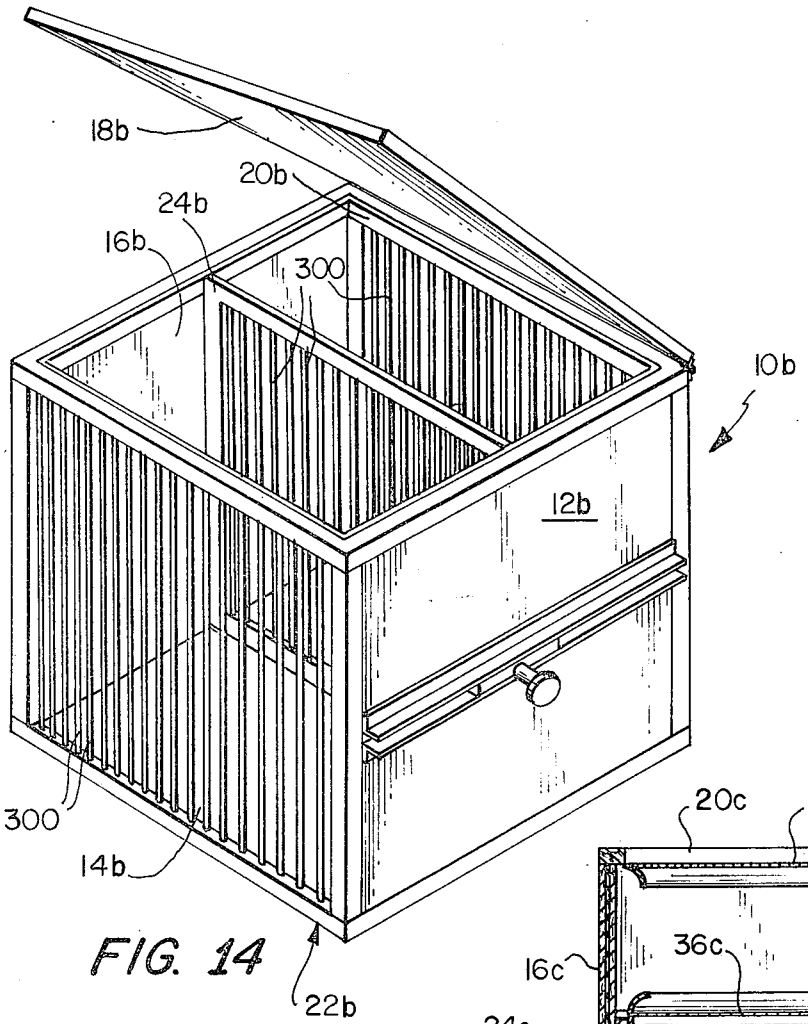

FIG. 5*a* is a top plan view of the structure shown in FIG. 5 without the modules;

FIG. 6 is a side elevational view of a conventional fork lift vehicle modified to handle modules constructed in accordance with the present invention;

FIG. 6*a* is a further view of the structure shown in FIG. 6;

FIG. 7 is a partially diagrammatic view of a modified form of a curing station;

FIG. 8 is a view similar to FIG. 7 of another form of curing station;

FIG. 9 is an elevational view of another form of curing station;

FIG. 10 is an elevational view of still a further form of curing station;

FIG. 11 is a perspective exploded partially sectional view of a modified form of curing module constructed in accordance with the present invention;

FIG. 12 is a perspective exploded partially sectional view of a further modification of the curing module;

FIG. 13 is an enlarged fragmentary view of a portion of the slidable baffles illustrated in conjunction with the module shown in FIG. 12;

FIG. 14 is a perspective view of a modified form of the module;

FIG. 15 is a perspective view of a further form of the module of the present invention, and FIG. 16 is a section on line 16—16 of FIG. 15.

Figure 1:
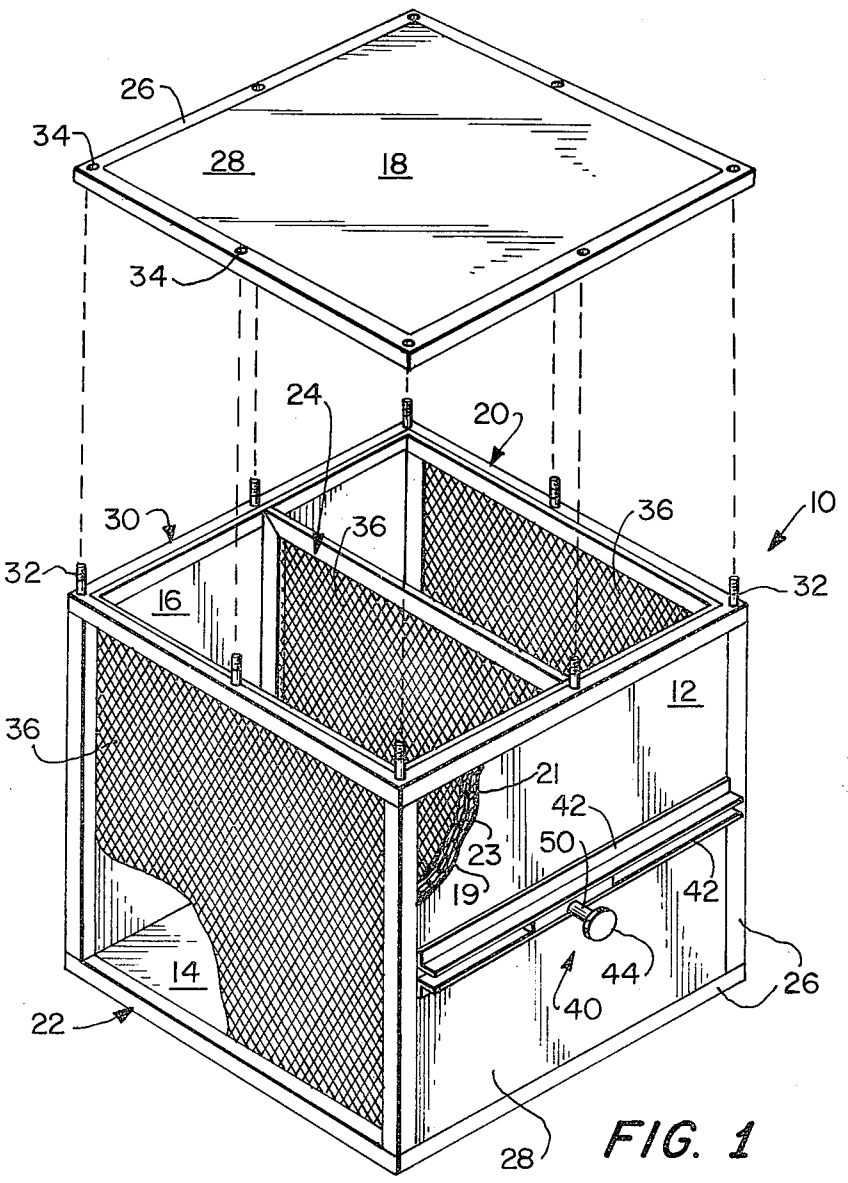
FIG. 1 is a perspective exploded view partially in section of a tobacco curing module constructed in accordance with the teachings of the present invention.

Referring now to the drawing and in particular to FIG. 1, 10 generally designates one of the containers or modules for the curing of tobacco in accordance with the teachings of the present invention. The module 10 includes imperforate sides 12, 14, 16, and 18, and perforate sides 20 and 22. In the illustrated form of the invention the module 10 or container is cubicle in configuration and a module of 4 feet × 4 feet × 4 feet inside dimensions, is designed to hold from about 900 to about 1500 pounds of uncured tobacco leaf with an empty container weight of about 300 to about 500 pounds. The total weight of a filled container of said dimensions would be about 1200 to 2000 pounds. A module having five foot internal dimensions when filled with tobacco would weight approximately one to 1.5 tons when the module is of predominantly wooden construction with metal screens in the side wall 20 and 22 and with a screened center partition generally designated 24.

Each of the imperforate side walls 12, 14, 16, and 18 is formed with a metal or wooded peripheral frame 26 and a panel 28 of plywood or preferably each of the imperforate walls of the module is constructed of double layers of plywood 19 and 21 spaced by insulation 23. The insulation is preferably or rigid from material such as Styrofoam which has excellent insulating properties with substantial resistance to compression. The side walls 12, 14, and 16 are rigidly and integrally formed with side walls 20 and 22 whereas side wall or cap 18 is removable as illustrated in FIG. 1. After the module is filled the side wall 18 is secured to the other side walls of the container by a plurality of studs 32 anchored in the peripheral wall 30. The studs are received in bores 34 in the peripheral edge of wall 18 and secured thereto by suitable wing nuts or the like. It will also be appreciated by those skilled in the art that in place of the studs 32 and cooperating wing nuts other separable fastening means may be employed with the module of the invention. Furthermore the side wall 18 may be hinged on one side to effect closure of the module as to be described in reference to FIG. 14.

The end walls 20 and 22 and the partition wall 24, are, as hereinbefore described, perforated and in the illustrated form of the invention the walls comprise expanded metal screening having a high ratio of open space to meetal. The primary function of the expanded metal screen 36 is to retain the tobacco leaves in whole or in cut strip form within the container during subsequent handling and during the curing stage while permitting substantial volume flow of heated treated gases to pass therethrough with a minimum of resistance.

As to be further described hereinafter the perforated walls may comprise perforated metal, expanded metal, plastic or metal ribs formed to provide parallel ridges and valleys etc.

As hereinbefore set forth, in view of the weight of even the relatively small modules of the 4 feet × 4 feet × 4 feet type, the module 10 includes a lug generally designated 40 on each of the side walls 12 and 16. The lugs 40 are retained on the side walls by a pair of angle irons 42 and 44 whose primary function is to distribute the weight of the load throughout the carrying side walls. Further, it will be noted that the lugs 40 include end plate members 44 which, as to be more fully described, cooperate with lifting slings 46, FIGS. 6 and 6*a*, provided with shaped openings 48 which are slipped over the end plates 44 and securely engage the shaft portions 50 thereof.

In FIGS. 6 and 6*a* the carrying rings 46 are chain connected to a pair of side-by-side horizontal arms 52, secured to the lifting face 54 of a conventional fork-lift vehicle generally designated 56. Each of the horizontal support arms 52 is suitably braced as at 58 whereby the modules 10 may be readily moved from their filling stations to supplemental hauling means to be described in reference to FIGS. 5 and 5a, and placed and or turned and stacked in the curing station as to be more fully described in reference to FIGS. 2 through 4, and 7 through 10.

Referring to FIGS. 5 and 5*a* where the filling of the module 10 is remote from the curing station, the modules may be transported between the harvester and/or leaf slicer and the curing station on small tractor drawn dollies generally designated 70. The dolly 70 includes a platform 72 forming a flatbed to receive a pair of the modules which platform is suitably rotatably mounted via axle 74 and wheels 76. The flatbed of the dolly may comprise a plurality of elongated rollers generally designated 78 which rollers are mounted in banks of pairs designated A and B so that the modules 10 can be simply rolled from the dolly into the assigned spaces at the curing station. In order to anchor the modules on the dolly bed a crossbar 80 for each section A and B is provided with end recesses 82 which are adapted to receive stop pins 84 after the modules are positioned on the dolly.

Figure 2:
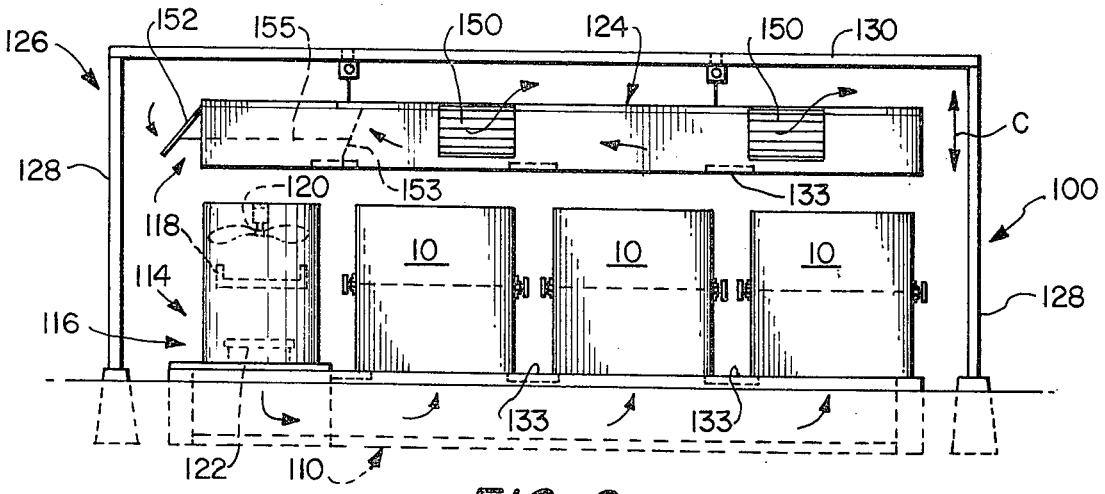
FIG. 2 is an elevational view of a form of tobacco curing station including six of the modules such as illustrated in FIG. 1.
Figure 3:
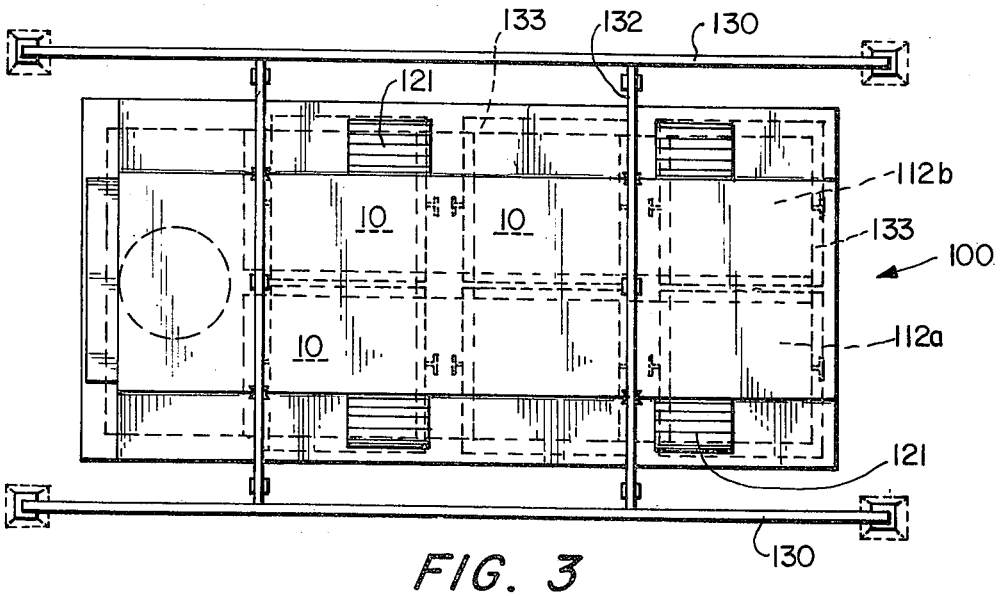
FIG. 3 is a top plan view of the structure shown in FIG. 2.
Figure 4:
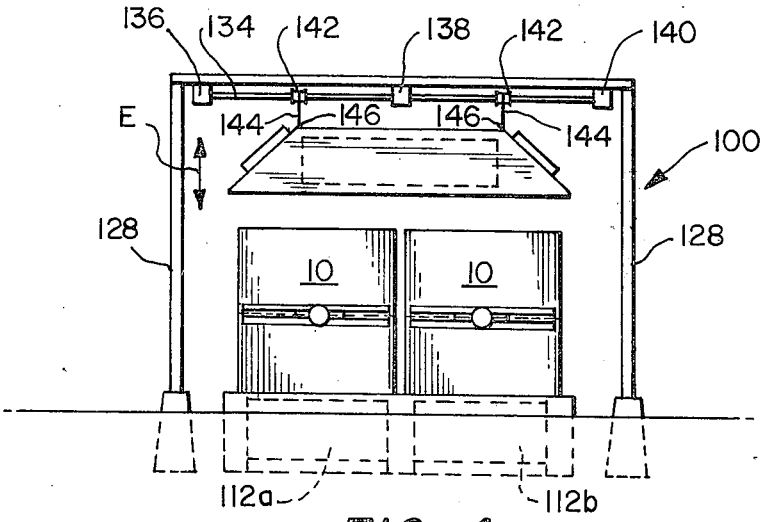
FIG. 4 is the right end view of the structure shown in FIGS. 2 and 3.

Referring now particularly to FIGS. 2 through 4, one of the novel curing stations forming one aspect of the present invention is generally illustrated at 100. In these figures the curing station is adapted to receive six of the modules 10 in two rows of three. The curing station 100 includes a foundation generally designated 110 which is built to provide a pair of air channels 112*a* and 112*b* which are open in the zone of each of the modules are shown in the broken section of FIG. 3 of the drawings. At end 114 of the curing station is mounted a furnace generally designated 116. The furnace includes a burner or heater 118, a draft creating means such as motor-driven fan 120, and a humidifier 122. Above the modules 10 and the furnace 116 is an upper plenum chamber generally designated 124. The upper plenum chamber 124 is suspended from a frame 126 which frame includes corner posts 128 and longitudinal and transverse cross members 130 and 132 respectively. The transverse members 132 carry on their under surfaces shafts 134 suitably rotatably mounted in bearings 136 adjacent one of the longitudinal runners 130 and in the center and suitable drive means along the opposite sides generally designated 140. The shafts 134 carry pulleys or shives 142 over which are trained flexible draft members 144 having their extended ends connected to the top portion of the upper plenum chambers 124 as at 146. By means of the shafts 134, the pulleys 142, the flexible draft members 144 and suitable motive means, the upper plenum chamber may be raised and lowered as illustrated by the directional arrow C, FIGS. 2 and 4 of the drawings.

About each of the generally rectangular openings formed in the upper and lower plenum chambers a suitable gasketing material 133 is mounted, such as, ½ inch × 4 inches rubber. The gaskets 133 seal each module between the upper and lower plenums. With six modules positioned as shown in FIGS. 2 – 4 it is not difficult to develop a static pressure up to 4 inches of water with negligible air leakage. The top surface of the lower plenum 110 in the zone to receive the module 10 may be formed as open slat work such as illustrated at 121. The open slat work 121 may comprise spaced rollers such as previously described in reference to FIG. 5 whereby the module may be directly rolled from the transporting dolly 70 into position on the lower plenum chamber.

In FIGS. 2 and 3, the upper plenum chamber 124 is in its elevated position to thereby permit insertion of the modules 10 or removal or rotation thereof. Once the modules 10 are in the desired position the upper plenum chamber is lowered so that there is a closed flow path for the heated and/or heated and humidified curing air as illustrated by the directional arrows. The upper plenum chamber is also provided with suitably controllable outlet dampers in the side walls as illustrated at 150, and an inlet damper in the end wall as illustrated at 152 whereby a portion of the circulated air may be exhausted through dampers 150 and make up air may be added at damper 152.

The damper system also includes a recirculation damper 153 which is connected to damper 152 by control rod 155 so that as one opens the other closes. The outlet dampers 150 are preferably of the gravity-vane type which open or close due to changes in the static pressure in the plenum, due to changes in positioning of the recirculation damper 153.

In operation of the curing station as shown in FIGS. 2, 3, and 4, six modules filled with tobacco are positioned as shown with the open screen sides being in register with the upper and lower plenum chambers 134 and 110. After a suitable time of curing as to be more fully described the upper plenum chamber 124 may be raised and each of the modules 10 may be rotated 180 degrees so that the original open top portion of the module is in the downward position. This rotation serves to speed the curing and at the same time improves the uniformity of the finished product.

A modified form of curing station is illustrated in FIG. 7 and generally designated 100*a*. The curing station 100*a* includes upper plenum 124*a* and lower plenum 110*a* and a furnace section 116*a*. The lower plenum 110*a* includes a plurality of outlet dampers 150*a* and an inlet damper 152*a* which elements correspond to their complementary elements in FIG. 2. The top plenum 124a is also suspended for vertical movement on a frame 126 as in the form of the invention shown in FIGS. 2, 3, and 4. In this form of the invention the direction of flow of air from the furnace 116a is opposite to that shown in FIGS. 2, 3, and 4. It is also contemplated that a reversible motor may be provided for the draft means 120, FIG. 2, and 120*a*, FIG. 7, so that during a portion of the cycle air is passed in one direction through the modules and during the other half of the drying cycle air is passed in a reverse direction of flow. Using the reverse direction of flow method of operation has the similar advantage to that of rotating the module 10 180° during curing. However, using the reverse flow of curing gas movement complicates to some extent the operation of the dampers 150, 150*a*, 152, 152*a* and the recirculation dampers, 153 and 153*a*.

Referring to FIG. 8, another form of the curing station is illustrated and generally designated 100b. In this form of the invention there is provided a lower plenum chamber 110*b* similar in construction and function to the lower plenum chamber 110, FIGS. 2 – 4, and an upper plenum chamber 124*b*, also similar in structure and function to that illustrated in FIGS. 2 – 4. A furnace 116*b* is provided at end 114*b* and the upper plenum chamber 124*b* is suitably supported from the framework 126*b* whereby the upper plenum chamber 124*b* may be raised and lowered. The primary distinction between this form of the invention and that illustrated in FIGS. 2 – 4 is in the height of the furnace 116*b* which height is sized to permit stacking of two rows C and D of modules 10 to either reduce the width of the curing station or to double its capacity for the same ground area.

The upper plenum is provided with flow control dampers 150*b*, 152*b* and 153*b* as in the other described form of my invention.

Referring to FIG. 9 a modified curing station 100*c* is illustrated and in this form of the invention the upper plenum chamber 124*c* is formed as two sections 160 and 162. Section 160 is immovably mounted to the upper end of the furnace 116*c* while the section 162 is suitably mounted from the framework 126*c* for vertical lifting movement whereby the module 10 may be suitably placed on top of the lower plenum chamber 110*c*. Section 160 and section 162 of the upper plenum chamber 124*c* are connected by an accordion type expansible joint generally designated 164.

Referring now to FIG. 10, a further curing station 100d is shown. In this form of the invention the upper and lower plenum chambers 124*d* and 110*d* respectively are arranged such that the furnace and draft creating means 116*d* is mounted in the center and flow of curing gases is controlled by dampers 166, 168, 170, and 172 in addition to inlet damper 152*d* and outlet damper 150*d*. The first pair of dampers is mounted in the upper plenum chamber 124*d* and the second pair in the lower plenum chamber 110*d*. Two banks of containers or modules 10 rest on the lower plenum and connect with suitable passages in the upper plenum so that gas flow through this device is as illustrated by the directional arrows. In addition to being able to handle a substantial number of curing modules, this form of the invention also has the added feature that by, for example, closing dampers 166 and 170, only half of the unit may be employed during the non-peak production times.

Referring now to FIG. 11, a modified form of module is illustrated at 10*a*. In this form of the invention the module includes the gas impervious side walls 12*a*, 14*a*, 16*a*, and 18*a* constructed as shown and described with reference to FIG. 1. Further, this form of the invention also includes gas pervious side walls 20*a* and 22*a* corresponding to walls 20 and 22 of the FIG. 1 form of the invention. The module 10*a* differs from the module 10 in that a pair of parallel gas pervious walls 24a and 24*b* are mounted within the module parallel to the gas pervious walls 20*a* and 22*a*. The gas pervious interior walls 24*a* and 24*b* divide the space within the module into three compartments. Dividing the module into a greater number of compartments reduced packing of the tobacco during handling and assists in insuring a more uniform airflow through the device. As in the previous form of the invention, handling lugs 40*a* are provided on each of the side walls 12 *a* and 16*a*.

It has been found in use of the modules constructed in accordance with the present invention that as the tobacco loses moisture it shrinks in bulk and in some cases the shrinkage occurs greatest along one of the imperforate walls thus increasing the time required to fully cure the tobacco. This sneakage of gas along an imperforate wall may be controlled by the installation of baffles along the peripheral margins of the gas pervious screen walls. A module constructed in this manner is illustrated in FIGS. 12 and 13. In FIGS. 12 and 13 the module 10*b* includes imperforate walls 12*b*, 14*b*, 16*b*, and 18*b*, with walls 12*b* and 16*b* being provided with handling lugs 40*b* as previously described in reference to FIGS. 1 and 11. Further, the module includes gas pervious open-mesh screened end walls 20*b* and 22*b* and interior perforate partition wall 24*b*. Each of the open-mesh screened walls 20*b*, 22*b*, and 24*b*, are provided about their peripheral edges with metal, wood, or plastic baffle members 200, more clearly shown in FIG. 13. The baffles 200 are secured to the margins or frames 26*b* by means of screws or other anchor type fasteners generally designated 202. The fasteners 202 pass through elongated slot-like openings 204 in the baffles which permit the baffles to be moved in the direction of the directional arrows E, FIG. 13, to thereby regulate within limits the area of the screens to be blocked by the baffles. It has been found that after the tobacco has partially dried baffles extending, inwardly for example, 3 to 8 inches, provide greater control of gas sneakage along imperforate walls and by means of the slidable and adjustable baffles 200 this control may be readily available to the operator.

Referring now to FIG. 14, modified form of module is illustrated at 10*b*. In this form of the invention the module includes the gas impervious side walls 12b, 14b, 16*b*, and 18*b* constructed as shown and described with reference to FIG. 1 except that wall 18*b* is hinged to one of the other side walls. Further, this form of the invention also includes gas pervious side walls 20*b* and 22*b* corresponding to walls 20 and 22 of the FIG. 1 form of the invention, and parallel gas pervious wall 24*b* mounted within the module parallel to the gas pervious walls 20*b* and 22*b*. The gas pervious walls 20*b*, 22*b* and 24*b* are formed with spaced parallel bars, ribs or rods 300 instead of screen or expanded metal 36 as in FIG. 1 of the drawings. The bars run vertically such that they are perpendicular to the general plane of the tobacco leaves or cut strips. The bars give less resistance during packing, and hence less folding of lamina. Furthermore, when the module is rotated by 90°, the tobacco can distort and settle slightly between the bars to provide increased opening for air movement into the tightly packed tobacco. By decreasing this "interfacial resistance" between the tobacco and the support screen, even further advances can be made in loading capacities with high efficiency and uniformity of drying.

Spacing of the parallel bars should be such that the material is adequately supported with minimal slippage or loss between the bars. For example with 3 inches × 3 inches strips, a spacing of about 1.5 inches between the bars should be satisfactory. For intact random leaves, a spacing of about 3 to 6 inches should adequately support the material, of course depending upon tobacco type.

Referring now to FIGS. 15 and 16 a further modified form of module is illustrated at 10*c*. In this form of the invention the module includes the gas impervious side walls 12*c*, 14*c*, 16*c*, and 18*c* constructed as shown and described with reference to FIG. 1. Further, this form of the invention also includes gas pervious side walls 20*c* and 22*c* and parallel partition wall 24*c* corresponding to walls 20 and 22 of the FIG. 1 form of the invention. The module 10c differs from the module 10 in that the inner peripheral edges of the strips 200*c* carrying the screen 36*c* and against which the weight of the tobacco bears when the module is rotated are provided with inwardly curved, integral lips 302. The edges of the lips thus bear perpendicularly against the tobacco leaves when the container is rotated 90° during tobacco curing and thus assist in directing air flow through the tobacco.

From the foregoing description of specific embodiments of the present invention it will be seen that the aims and objects hereinbefore set forth are fully accomplished, to thereby provide a method and apparatus for full modular handling and curing of tobacco which greatly simplifies the materials handling problems and offers to the industry a further opportunity for labor and cost reductions.

In use of the system of the invention either cut strip or intact tobacco leaves are packed into the compartments, container, or module, to a loading density of about, for example, 14 to 20 pounds per cubic foot. With the compartmented form of construction tobacco leaves or strips will normally assume generally horizontal positions when allowed to freefall into the module. Whole oriented leaves may also be easily hand packed into the module, preferably with the butts (petioles) resting against the perforate wall or screen supports, such that the butts provide substantial support for the lamina when the module is capped and rotated by 90 degrees for curing. After the module is filled the cap or removable end wall is secured to the module. After capping the module is readily rotated 90° in the vertical plane by means of the rods located near the centers of opposed non-perforate side walls of the module. After rotating, the screens or air pervious walls of the module are positioned in a horizontal plane to permit vertical movement of forced air between the leaves or strips which due to rotation are now in the vertical mode.

The filling may be such that orientation of the tobacco within the container is intact random, oriented with butts resting on the perforate walls, and cut-strip with the general plane of the lamina vertical when in the position for airing.

The filled, capped and rotated modules are then sent to a curing station which in the preferred form of the invention would be the curing system shown in FIGS. 2 through 4, and 7 through 10; however, the modules may be placed in conventional bulk curing barns in place of the usual racks. Assuming the use of the curing system of the present invention, six filled modules are positioned on the lower plenum as illustrated in FIGS. 2, 3, and 4 and once positioned the top plenum is lowered to provide the top seal for the modules. Positioning of the modules on the lower plenum may be carried out by means of the fork-lift device shown in FIGS. 6 and 6*a*. With the top plenum lowered a complete seal is made around the top of each module and the furnace to give a continuous passage for recirculating air substantially without leakage.

As hereinbefore discussed, the top plenum also includes inlet, recirculation and exhaust dampers which are used in controlling humidity conditions during curing. With the inlet damper open and recirculation damper closed, fresh air is drawn into the furnace, forced upwardly through the tobacco and discharged through the lower ventilator. With the inlet damper closed and the recirculation damper open, air recirculates to establish high humidity. At various stages during curing the inlet and recirculation dampers may be adjusted over a range of settings to establish the desired humidity for curing.

In a prototype a fan associated with the curing station furnace was selected to deliver about 1.5 cubic foot per minute per pound of uncured tobacco at a static pressure of approximately two to three inches water column. Thus, with six modules containing, for example, 6000 pounds of uncured tobacco the blower or fan should deliver from about 6000 to 9000 cubic feet per minute at about two inches of water static pressure. Under these circumstances the furnace should deliver approximately 250,000 BTU's/hour for satisfactory drying at the maximum drying stage and the furnace may be of the direct fired gas or indirect fired oil burner types.

Since it has been found that certain problems frequently encountered during tobacco curing such as bacterial decay occur near the top of curing barns and tobacco yellows unevenly with the yellowing occurring faster where the air is introduced, the curing module may be rotated at timely stages during curing to provide for more uniform yellowing, drying, and conditioning.

As hereinbefore described, the loading density of tobacco for the modules will vary with the size of the tobacco material loaded therein and the size of the module; hence it is recommended that while 14 through 20 pounds per cubic foot density would probably be optimum, a range of from about 10 pounds to about 25 pounds per cubic foot would be functional.

While it is not an object of the present invention to provide optimum curing cycle parameters, the following schedule will produce vary satisfactorily cured tobacco (for flue-cured type). After the tobacco has been placed in the curing station the fan is energized and the thermostat set for coloring, that is, yellowing, at about 90° to about 105°F. The dampers are adjusted for essentially complete recirculation of the air. If the tobacco is wet the surface water may be removed by venting to the outside for several hours. During this coloring phase the tobacco leaf turns yellow as chlorophyl oxidized, unmasking the yellow pigments of the plant. Important biochemical changes also occur during this phase, including starch hydrolysis and proteolysis. This period of cure generally requires from about 30 to about 72 hours depending on leaf position and maturity at harvest.

After this first phase the temperature within the curing chambers is gradually increased at about two to three degrees Fahrenheit per hour until reaching about 130° to 135°F. This temperature is maintained until the majority of lamina is dried. During this time the humid air is exhausted by gradually opening the intake dampers while closing the recirculation damper. After lamina drying the temperature is then increased at about 2° to 5°Fahrenheit per hour until reaching about 170°F. where final stem drying occurs. Final leaf and stem drying under the conditions set forth above requires about two to three days so that the total yellowing and drying may require from about four to six days. It is also recommended that at the latest stages of curing that the intake damper of the curing station be adjusted to a near closed position to permit a high percentage of air recirculation to thereby conserve fuel.

Following curing, the tobacco may be brought into condition, that is, remoistened to 15 to 18 percent moisture by opening the ventilators and circulating outside air through the tobacco or by injecting moisture into the air via the humidifier in the heater section, as shown in the drawings. Following conditioning, the tobacco is then ready for preparation for market and the module may be readily unloaded by merely removing the cover or cap and rotating then so that the removable cover or cap is in a downward direction.

While the above operating procedure has been described for tobacco of the flue-cured type, it is apparent that the system may be used for curing other tobaccos such as Burley, Maryland, cigar tobacco, Oriental, etc. by simple modification of temperature- time schedules.

Further while the present invention has been developed primarily for tobacco curing, it is recognized that other crops could be dried using the identical system. Said other crops may include sweet potatoes, peanuts, corn, tea leaves, onions, grain, fruits, and vegetables etc.

I claim:

1. A curing or drying container for tobacco in intact or cut strip for use in a multiple container curing station, said container being of generally rectangular solid configuration comprising two pairs of opposed generally imperforate side walls forming gas flow directing means and the side walls of a curing station and a pair of opposed gas permeable perforate side walls for the passage of curing or drying gas therethrough, at least one immovable interior transverse perforate wall parallel to the opposed perforate walls, and means releasably securing one of the opposed imperforate walls to the others to thereby form an access opening for the container said two pairs of opposed imperforate side walls are heat insulating and wherein said pair of perforate side walls and said interior transverse wall are provided with peripheral baffles.

2. The invention defined in claim 1 wherein said two pairs of opposed imperforate side walls and the pair of opposed gas permeable side walls form a cube.

3. The invention defined in claim 1 wherein the insulating walls comprise a pair of spaced panels with insulating material therebetween.

4. The invention defined in claim 1 wherein the are a pair of spaced parallel interior transverse perforate walls dividing the interior of the container into three compartments.

5. The invention defined in claim 4 wherein the interior compartments are of uniform volume.

6. The invention defined in claim 1 including materials handling means projecting from one pair of the opposed pairs of imperforate side walls.

7. The invention defined in claim 6 wherein said materials handling means comprise lifting lugs mounted substantially at the center of gravity of said side walls.

8. The invention defined in claim 1 wherein said baffles are slidably mounted to peripheral walls of said side walls and interior wall.

9. The invention defined in claim 1 wherein the permeable walls comprise screen.

10. The invention defined in claim 1 wherein the permeable walls comprise spaced rod members.

* * * * *